US011078572B2

(12) United States Patent
Wang et al.

(10) Patent No.: US 11,078,572 B2
(45) Date of Patent: Aug. 3, 2021

(54) METHOD AND DEVICE FOR PREPARING HIGH STRENGTH AND DURABLE SUPER-HYDROPHOBIC FILM LAYER ON INNER WALL OF ELONGATED METAL TUBE

(71) Applicant: NORTHEAST PETROLEUM UNIVERSITY, Daqing (CN)

(72) Inventors: Huaiyuan Wang, Daqing (CN); Ziyi Hu, Daqing (CN); Yanji Zhu, Daqing (CN); Yixing Zhu, Daqing (CN); Chijia Wang, Daqing (CN)

(73) Assignee: NORTHEAST PETROLEUM UNIVERSITY, Daqing (CN)

( * ) Notice: Subject to any disclaimer, the term of this patent is extended or adjusted under 35 U.S.C. 154(b) by 261 days.

(21) Appl. No.: 16/247,443

(22) Filed: Jan. 14, 2019

(65) Prior Publication Data

US 2019/0153604 A1 May 23, 2019

Related U.S. Application Data

(63) Continuation of application No. PCT/CN2016/100885, filed on Sep. 29, 2016.

(51) Int. Cl.
*C25D 11/34* (2006.01)
*C23C 18/16* (2006.01)
(Continued)

(52) U.S. Cl.
CPC ..... *C23C 18/1653* (2013.01); *C23C 18/1616* (2013.01); *C23C 18/1628* (2013.01);
(Continued)

(58) Field of Classification Search
None
See application file for complete search history.

(56) References Cited

U.S. PATENT DOCUMENTS 6,221,227 B1 4/2001 Kang et al.
2010/0044240 A1* 2/2010 Kimber ..... H01M 4/1395 205/262
2016/0002813 A1* 1/2016 Lomasney ..... B82Y 40/00 205/96

FOREIGN PATENT DOCUMENTS

CN 101532159 A 9/2009
CN 101665968 A 3/2010
(Continued)

*Primary Examiner* — Stefanie S Wittenberg

(57) ABSTRACT

Method for preparing high-strength and durable super-hydrophobic film layer on inner wall of elongated metal tube includes roughening treatment of inner wall of a metal tube, electrodepositing preparation of nickel-phosphorus alloy layer and functional coating, heat treatment, subsequent anodizing and low surface energy modification. The method greatly reduces the influence of local mass transfer resistance, and a uniform nanocrystalline film layer is electroplated under the ultrasound induction. Since only electroplating solution is filled in the tube during the preparation process, the consumption of device and raw materials is greatly reduced. Also, since silica particles are added to the electroplating solution in preparing the nanocrystalline film layer, the surface morphology can be made more uniform and denser in terms of the microscopic morphology. Nanoscale channels structures are etched, so that the super-hydrophobic inner surface can have a better ability to store air, and its water flow impact resistance is greatly enhanced.

7 Claims, 6 Drawing Sheets

(51) Int. Cl.

| | |
|---|---|
| ***C23C 18/50*** | (2006.01) |
| ***C23C 18/18*** | (2006.01) |
| ***C25D 5/48*** | (2006.01) |
| ***C25D 5/08*** | (2006.01) |
| ***C25D 17/00*** | (2006.01) |
| ***C25D 5/14*** | (2006.01) |
| ***C25D 7/04*** | (2006.01) |
| ***C25D 5/50*** | (2006.01) |
| ***C25D 5/34*** | (2006.01) |
| ***C25D 5/44*** | (2006.01) |
| ***C25D 15/00*** | (2006.01) |
| ***C25D 3/18*** | (2006.01) |
| ***C25D 5/20*** | (2006.01) |
| ***C25D 5/36*** | (2006.01) |
| ***C23C 18/36*** | (2006.01) |

(52) U.S. Cl.

CPC ..... *C23C 18/1637* (2013.01); *C23C 18/1666* (2013.01); *C23C 18/1692* (2013.01); *C23C 18/1827* (2013.01); *C23C 18/1834* (2013.01); *C23C 18/36* (2013.01); *C23C 18/50* (2013.01); *C25D 3/18* (2013.01); *C25D 5/08* (2013.01); *C25D 5/14* (2013.01); *C25D 5/20* (2013.01); *C25D 5/34* (2013.01); *C25D 5/36* (2013.01); *C25D 5/44* (2013.01); *C25D 5/48* (2013.01); *C25D 5/50* (2013.01); *C25D 7/04* (2013.01); *C25D 11/34* (2013.01); *C25D 15/00* (2013.01); *C25D 17/00* (2013.01)

(56) References Cited

FOREIGN PATENT DOCUMENTS

| | | | | | |
|---|---|---|---|---|---|
| CN | 102199783 | A | | 9/2011 | |
| CN | 102776548 | A | | 11/2012 | |
| DE | 102009014588 | B4 | | 7/2013 | |
| KR | 1615749 | | * | 4/2016 | ..... C25D 11/02 |

* cited by examiner

METHOD AND DEVICE FOR PREPARING HIGH STRENGTH AND DURABLE SUPER-HYDROPHOBIC FILM LAYER ON INNER WALL OF ELONGATED METAL TUBE

RELATED APPLICATION

The application is a continuation application of the international application PCT/CN2016/100885 filed Sep. 29, 2016, which is incorporated herein by reference in its entirety.

FIELD OF THE INVENTION

The present invention relates to a method and a device for preparing a high strength and durable super-hydrophobic film layer on an inner wall of an elongated metal tube.

BACKGROUND OF THE INVENTION

At present, there are many problems in the processes of production, transportation and storage, etc., of oil and gas as well as chemical fluids, among which the most prominent problems are corrosive wear and high energy consumption, including corrosion of corrosive media on the inner surface of tubes or vessels, and a significant amount of energy which is consumed in order to overcome the frictional resistance during the fluid transportation. Therefore, the functional coating technology of the inner wall of the tube has always been one of the key directions to solve the above problems.

Over the recent decade, inspired by the lotus effect in nature, resistance reduction, anti-corrosion and preparation techniques of the super-hydrophobic surface have attracted attentions. In general, the super-hydrophobic surface has excellent water droplet sliding characteristic, i.e., with a static water contact angle (WCA) of greater than 150° and a sliding angle (SA) of less than 10°. When such surface is submerged in water, the air film layer formed at the interface allows it to have many unique properties such as resistance to fluid medium corrosion and reduced flow resistance. Although there have been some cases in the implementation of a stable, tough super-hydrophobic surface on a small-sized flat plate, the implementation on the inner wall of the elongated metal tube is rarely reported, and industrial applications thereof are limited. At the same time, limited by factors such as design of reactor size and space complexity, etc., the implementation of the super-hydrophobic film layer on the inner wall of the elongated metal tube is difficult or it is difficult to ensure its uniformity and good bondability. Based on the demand for stable and uniform reaction mechanism, the preparation of the super-hydrophobic film layer in a narrow tube cavity of practical application has always been one of the main difficulties in the industrial amplification of the current preparation processes, for example: it is difficult to implement chemical vapor deposition (CVD), photolithography or spray coating in a narrow space. As a feasible method, electrodeposition also faces many technical limitations, because with controlling surface growth by metal ion diffusion mechanism, such method may be more susceptible to problems such as uneven partial discharge and uneven mass transfer in the microfluidic field, etc. Therefore, it is difficult to obtain a high-quality film layer having application values on a complicated inner surface.

At present, the internal treatment method of a super-hydrophobic tube is generally used, first, the chemical etching is performed, followed by post-fluorination modification, however, the method has less controllability on the structural size of the surface morphology, and when the hydrophobicity is lost, there is a risk of direct exposure of the substrate material into the corrosive media; second, the self-assembly of low surface energy substance (e.g., dimethyl siloxane) through a coupling agent on the inner surface of an elongated tube is allowed, however, this method has complicated process conditions and poor repeatability, the assembled film layer is thin (generally less than 500 nm), thus it is difficult to ensure mechanical wear resistance and cannot be adapted to industrial applications.

It can be seen that the preparation of a uniform, structurally stable and durable super-hydrophobic film layer in an elongated conveying tube is of great significance for reducing industrial transportation energy loss and anti-corrosion of tubes, however, it also faces technical limitations and is difficult to be implemented.

OBJECTS AND SUMMARY OF THE INVENTION

The embodiment of the present invention provides a method for preparing a high strength and durable super-hydrophobic film layer on an inner wall of an elongated metal tube (which can reach more than 1 m).

A method for preparing a high-strength and durable super-hydrophobic film layer on an inner wall of an elongated metal tube according to an embodiment of the present invention includes the following steps: roughening treatment of an inner wall of a metal tube: etching the inner wall of the metal tube with 2 mol/L to 4 mol/L of nitric acid or 2 mol/L to 4 mol/L of hydrochloric acid for 5 min to 30 min, so that a rough structure is formed on the inner wall of the metal tube, and exposing the active surface of the inner wall of the metal tube; preparation of a nickel-phosphorus alloy layer: depositing a nickel-phosphorus alloy layer on the inner wall of the rough metal tube by use of an electroless plating method, wherein the first plating solution used in the electroless plating method comprises: 0.1 mol/L to 1 mol/L of nickel chloride hexahydrate, 0.1 mol/L to 1 mol/L of sodium hypophosphite, 0.1 mol/L to 1 mol/L of trisodium citrate and 0.001 mol/L to 0.01 mol/L of brightener, and the temperature of the plating bath being 60° C. to 90° C.; preparation of a functional coating: electrodepositing a functional coating on the nickel-phosphorus alloy layer, wherein the electrodeposition bath is operated under an ultrasonic environment to form a uniform nanocrystalline film layer having a significant micron- or submicron-sized channel structure, wherein the second plating solution used for electrodeposition of the functional coating comprises: 0.01 mol/L to 0.1 mol/L of nickel sulfate hexahydrate, 0.1 mol/L to 1 mol/L of nickel chloride hexahydrate, 0.1 mol/L to 1 mol/L of boric acid, 0 mol/L to 0.1 mol/L of silica particles and 0.001 mol/L to 0.05 mol/L of amphiphilic substance, the temperature of the plating bath being 15° C. to 50° C., the ultrasonic frequency for the plating bath being 20 kHz to 60 kHz, the power being 150 W to 400 W; heat treatment step: performing heat treatment on the surface of the functional coating, the temperature of the heat treatment being 100° C. to 350° C., the time being 0.5 h to 2 h; anodizing step: inserting the metal tube as an anode and the nickel wire as a cathode into the cavity of the metal tube, and anodizing under the condition of fluid circulation at room temperature for 1 min to 10 min, and the applied voltage being 1 V to 5 V, wherein the composition of the plating solution for the anodizing step includes 0.25 mol/L to 0.1 mol/L potassium chloride at pH of 2.0 to 6.0.; low surface energy modification: performing low surface energy modification with a mixed solution of ethanol-water dissolved with a low surface energy substance, the mass ratio of ethanol to water in the mixed solution of ethanol-water being (1:9) to (9:1), the temperature of the mixed solution of ethanol-water being 60° C. to 90° C., and the time of the low surface energy modification being 1 h to 3 h.

A method for preparing a high-strength and durable super-hydrophobic film layer on an inner wall of an elongated metal tube according to the present invention utilizes low-power ultrasound to transfer energy through a fluid medium in the cavity of an elongated tube and the low-power ultrasound is not easily attenuated, therefore a stable ultrasonic field is formed throughout the cavity of an elongated tube, which greatly reduces the influence of local mass transfer resistance, and a uniform nanocrystalline film layer is prepared under the induction of ultrasound. Since only the electroplating solution is needed to be filled in the tube during the preparation process of the present invention, it is not necessary to completely immerse the plating pieces into the electroplating solution during the plating process, as long as the inner wall of the tube is passed through the circulating fluid, the entire tube section can be uniformly plated under special conditions, thereby greatly reducing the consumption of device and raw materials. At the same time, in the process of preparing the nanocrystalline film layer, silica particles are added to the electroplating solution which undergo high-frequency vibration under the action of the ultrasonic field, and continuously collide and rub against the surface of the newly formed deposited layer, so that the surface morphology can be made more uniform and dense in terms of the microscopic morphology. The contrast effect thereof is reflected in FIG. 3A. Then, the film layer obtained by ultrasonic assisted electrodeposition is continuously subjected to a controlled anodizing treatment, and the dissolution of the components at the grain boundary of the formed polymeric nanocrystalline preferentially occurs, thereby etching a plurality of nano-scale channel structures, so that the super-hydrophobic inner surface can have a better ability to store air, and its water flow impact resistance is greatly enhanced.

Further, prior to the preparation step of the nickel-phosphorus alloy layer, the cavity of the metal tube is filled with a first plating solution, and then a pure nickel wire is inserted into the metal tube, the metal tube is used as a cathode and the pure nickel wire is used as an anode, and is energized for 1 s to 30 s at an applied voltage of 1 V to 3 V, and then electroplated under a fluid circulation condition to prepare a nickel-phosphorus alloy layer.

Further, in the preparation step of the nickel-phosphorus alloy layer, the brightener includes one or more of leucine, sodium saccharin, coumarin or 1,4-butynediol.

Further, in the preparation step of the functional coating, the amphiphilic substance comprises one or more of octadecylamine, dodecanoic acid, tetradecanoic acid, and octadecanoic acid.

Further, in the preparation step of the functional coating layer, the silica particles have a particle size of 0.1 μm to 5 μm.

Further, in the low surface energy modification step, the low surface energy substance comprises one or more of heptadecafluorodecyl trimethoxysilane, tridecafluorooctyl triethoxysilane, tridecafluorooctyl trimethoxysilane and perfluorooctyl triethoxysilane.

Further, in the preparation step of the functional coating, the pure copper wire is prepared into a spiral shape to be inserted into the metal tube, and the pure copper wire is coaxial with the metal tube, and then the ultrasonic source is turned on to form a circulating fluid, after which the power is switched on, and is energized for 1 min to 30 min at an applied voltage of 0.5 V to 3 V to prepare a functional coating.

Another object of the present invention aims to provide a device for preparing a high strength and durable super-hydrophobic film layer on an inner wall of an elongated metal tube.

A device for preparing a high strength and durable super-hydrophobic film layer on an inner wall of an elongated metal tube according to the present invention comprises: a plating bath, a metal tube, a metal wire, a peristaltic pump, a power source, and an ultrasonic system; the plating bath contains a plating solution, the plating bath is disposed in the ultrasonic system; the metal wire penetrates into the metal tube, and both the first end of the metal wire and the first end of the metal tube penetrate below the liquid level of the plating solution. The metal wire is connected to a positive electrode of the power source, and the metal tube is connected to a negative electrode of the power source; one end of the peristaltic pump is connected to a second end of the metal tube, and the second end of the peristaltic pump penetrates below the liquid level of the plating solution.

Further, a device for preparing a high strength and durable super-hydrophobic film layer on an inner wall of an elongated metal tube according to the present invention, wherein the ultrasonic system comprises: a water bath, a heater, and an ultrasonic transducer.

Further, the metal wire is a spiral structure.

BRIEF DESCRIPTION OF FIGURES

FIG. 3A1 is an SEM image of an inner wall of a metal tube after undergoing the preparation step of the nickel-phosphorus alloy layer (the plating solution contains no silica particles);

FIG. 3A2 is an SEM image of an inner wall of a metal tube after undergoing the preparation step of the functional coating (the plating solution contains silica particles);

DETAILED DESCRIPTION OF THE EMBODIMENTS

In order to make the objects, technical solutions and advantages of the present invention clear, the present invention will be further described in detail below by listing the following examples with reference to the accompanying drawings.

It is an object of the present invention to provide a method of coupling ultrasonic assisted electrodeposition and subsequent anodic oxidation to form a uniform micro-nanoscale multi-level nanocrystalline film layer on the inner wall of an elongated metal tube, and through modification with a low surface energy substance, a super-hydrophobic layer with excellent wear resistance and water flow impact resistance can be manufactured. The method can be implemented on the inner wall of a metal tube that is more than 1 meter long. Those skilled in the art will appreciate that the method can also achieve good effects on metal plates.

Figure 1:
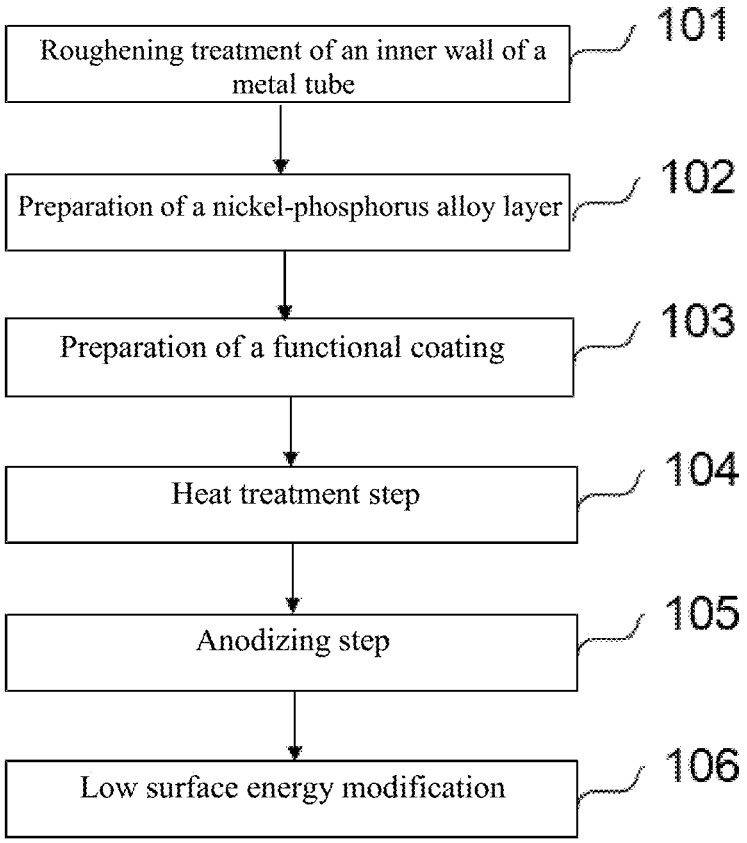
FIG. 1 is a flow diagram of a method for preparing a high-strength and durable super-hydrophobic film layer on an inner wall of an elongated metal tube according to the present invention.
Figure 2A:
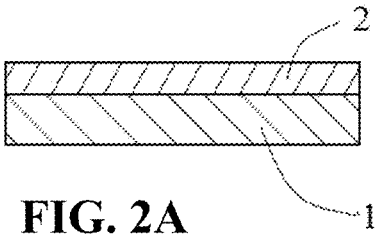
FIG. 2A is a schematic view showing the structure after depositing a nickel-phosphorus alloy layer on the inner wall of the metal tube.
Figure 2B:
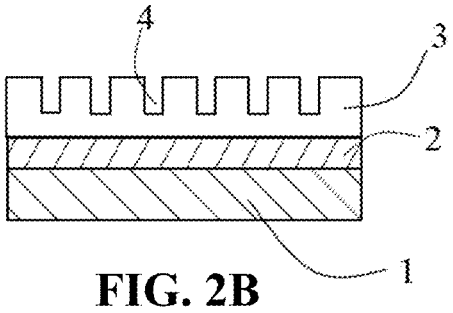
FIG. 2B is a schematic view showing the structure after depositing a functional coating on the inner wall of the metal tube.
Figure 2C:
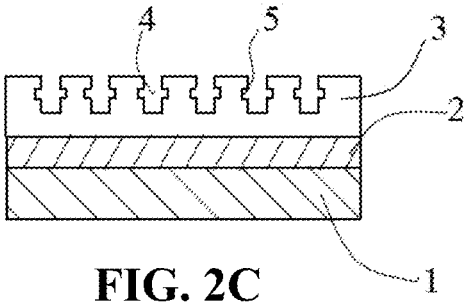
FIG. 2C is a schematic view showing the structure of an inner wall of a metal tube treated by an anodizing step.

As shown in FIG. 1, a method for preparing a high-strength and durable super-hydrophobic film layer on an inner wall of an elongated metal tube according to the present invention comprises the following steps:

roughening treatment of an inner wall of a metal tube S101: etching the inner wall of the metal tube with 2 mol/L to 4 mol/L of nitric acid or 2 mol/L to 4 mol/L of hydrochloric acid for 5 min to 30 min, so that a rough structure is formed on the inner wall of the metal tube, and exposing the active surface of the inner wall of the metal tube at the same time;

preparation of a nickel-phosphorus alloy layer S102: depositing a nickel-phosphorus alloy layer on the inner wall of the rough metal tube by use of an electroless plating method, as shown in FIG. 2A and FIG. 3A1, 1 is the inner wall of a metal tube, 2 is the nickel-phosphorus alloy layer, wherein the first plating solution used in the electroless plating method comprises: 0.1 mol/L to 1 mol/L of nickel chloride hexahydrate, 0.1 mol/L to 1 mol/L of sodium hypophosphite, 0.1 mol/L to 1 mol/L of trisodium citrate and 1.0 mol/L to 10 mol/L of brightener, and the temperature of the plating bath being 60° C. to 90° C.; The brightener includes one or more of leucine, sodium saccharin, coumarin or 1,4-butynediol. Specifically, the cavity of the metal tube is filled with a first plating solution, and then a pure nickel wire is inserted into the metal tube, the metal tube is used as a cathode and the pure nickel wire is used as an anode, and is energized for 1 s to 30 s at an applied voltage of 1 V to 3 V, and then electroplated under a fluid circulation condition to prepare a nickel-phosphorus alloy layer. Pre-plating a dense layer of a nickel-phosphorus alloy in the metal tube not only greatly enhances the anti-corrosive medium capacity of the film, but also facilitates the more regular and orderly growth of the nano-grains under ultrasound, thereby greatly improving the interlayer bonding force of the coating film. The hardness of the nickel-phosphorus alloy layer can reach more than 2H, and the metallic microscopic size structure is not easily damaged by the impact of high-strength fluid or friction of hard object, thereby ensuring the stability of the rough structure.

Preparation of a functional coating S103: electrodepositing a functional coating on the nickel-phosphorus alloy layer, wherein the electrodeposition bath is operated under an ultrasonic environment to form a micron- or submicron-sized channel structure, as shown in FIG. 2B, FIG. 3A2 and FIG. 3B, 3 is a functional coating and 4 is a micron or submicron-sized channel. Wherein, the second plating solution used for electrodeposition of the functional coating comprises: 0.01 mol/L to 0.1 mol/L of nickel sulfate hexahydrate, 0.1 mol/L to 1 mol/L of nickel chloride hexahydrate, 0.1 mol/L to 1 mol/L of boric acid, 0 mol/L to 0.1 mol/L of silica particles, 1.0 mol/L to 5.0 mol/L of amphiphilic substance and 1.0 mmol/L to 10 mmol/L of brightener, the temperature of the plating bath being 15° C. to 50° C., the ultrasonic frequency for the plating bath being 20 kHz to 60 kHz, and the power being 150 W to 400 W. The amphiphilic substance comprises one or more of octadecylamine, dodecanoic acid, tetradecanoic acid, or octadecanoic acid, the silica particles have a particle size of 0.1 μm to 5 μm, and the brightener includes one or more of leucine, sodium saccharin, coumarin or 1,4-butynediol. Specifically, the pure copper wire can be prepared into a spiral shape to be inserted into the metal tube, and the pure copper wire is coaxial with the metal tube, and then the ultrasonic source is turned on to form a circulating fluid, after which the power is switched on, and is energized for 1 min to 30 min at an applied voltage of 0.5 V to 3 V to prepare a functional coating.

Heat treatment step S104: performing heat treatment on the surface of the functional coating, the temperature of the heat treatment being 100° C. to 350° C., and the time being 0.5 h to 2 h. Since the amphiphilic substances will be co-deposited in the preparation step of the above functional coating, the surface of the structural layer needs to be subjected to high temperature treatment to lose hydrophobicity of the surface, and then the subsequent anodizing step is performed.

Anodizing step S105: inserting the metal tube as an anode and the nickel wire as a cathode into the cavity of the metal tube, and anodizing under the condition of fluid circulation at room temperature for 1 min to 10 min, and the applied voltage being 1 V to 5 V, wherein the composition of the plating solution for the anodizing step includes 0.25 mol/L to 0.1 mol/L of potassium chloride at pH of 2.0 to 6.0. Through the anodizing step, nanoscale channel structure 5 is continued to be formed along the grain boundaries of the nanocrystalline between the inner surface of the micron-sized pores of the nickel layer and the pores, as shown in the SEM photographs of FIGS. 2C and 3C.

Low surface energy modification S106: performing low surface energy modification with a mixed solution of ethanol-water dissolved with a low surface energy substance, the temperature of the mixed solution of ethanol-water being 60° C. to 90° C., and the time of the low surface energy modification being 1 h to 3 h. The low surface energy substance comprises one or more of heptadecafluorodecyl trimethoxysilane, tridecafluorooctyl triethoxysilane, tridecafluorooctyl trimethoxysilane and perfluorooctyl triethoxysilane.

Figure 3B:
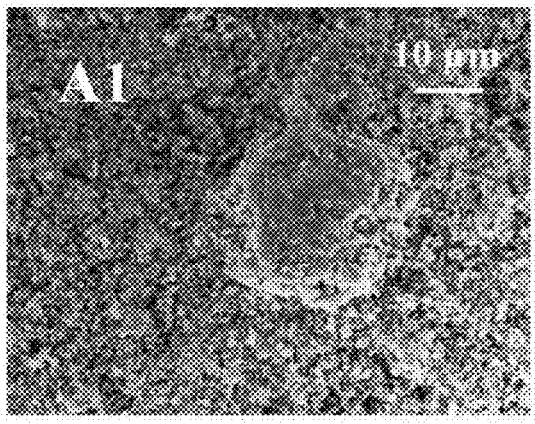
FIG. 3B is an SEM image of a cross section of an inner wall of a metal tube treated by a preparation step of a functional coating.
Figure 3B:
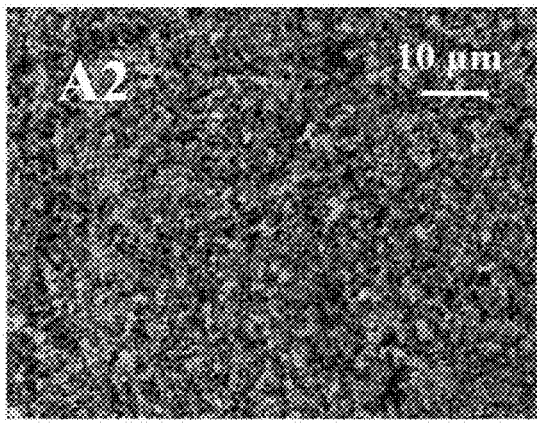
Figure 3B:
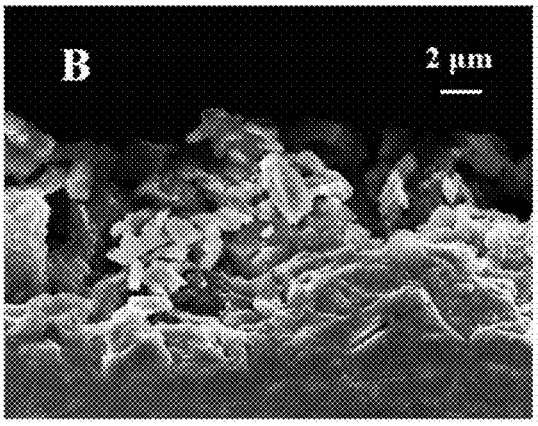
Figure 3C:
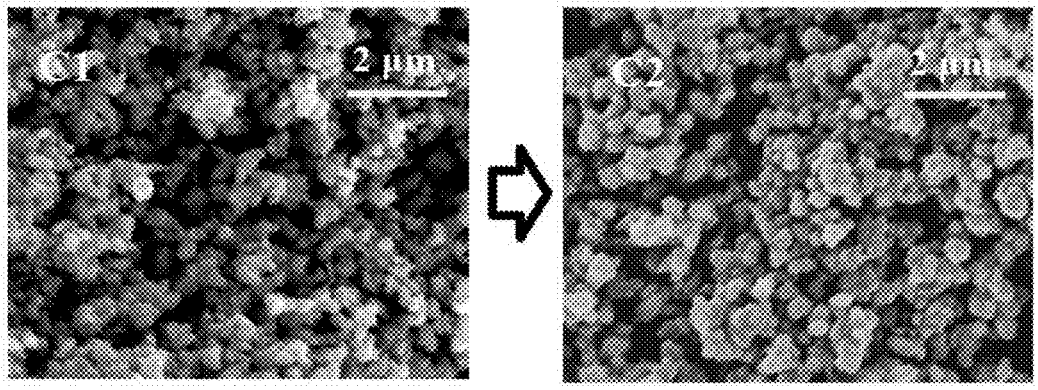
FIG. 3C is an SEM image of the effect of anodizing treatment on the adjustment of the surface morphology.

A method for preparing a high-strength and durable super-hydrophobic film layer on an inner wall of an elongated metal tube according to the present invention utilizes ultrasound to transfer energy in the cavity of an elongated tube, which greatly reduces the influence of local mass transfer resistance, and a uniform nanocrystalline film layer is prepared under the induction of ultrasound. Since the longitudinal wave and energy of ultrasound can propagate along the fluid medium, it is not necessary to completely immerse the plating pieces into the electroplating solution during the plating process, as long as the inner wall of the tube is passed through the circulating fluid, the entire tube section can be uniformly plated under special conditions, thereby greatly reducing the consumption of device and raw materials. Pre-plating a dense layer of a nickel-phosphorus alloy in the metal tube under the functional layer of the porous structure during the preparation process not only greatly enhances the anti-corrosive medium capacity of the film, but also facilitates the more regular and orderly growth of the nano-grains under ultrasound, thereby greatly improving the interlayer bonding force of the coating film. The hardness of the finally obtained deposited layer can reach more than 2H, and the metallic microscopic size structure is not easily damaged by the impact of high-strength fluid or friction of hard object, thereby ensuring the stability of the rough structure. As shown in FIG. 3B, the prepared film layer has a remarkable thickness exceeding 10 μm, which ensures its excellent mechanical abrasion resistance. Due to the combined action of direct contact of the dense nanocrystalline film layer, the super-hydrophobic surface blocking liquid and the solid phase, the inner wall of the tube has excellent resistance to fluid medium corrosion and self-cleaning property. On the other hand, the air film formed by plating the super-hydrophobic surface as passing through the fluid medium can effectively reduce the direct contact between the fluid and the rough structure at the interface and produce the slippage of the fluid particles, thereby greatly reducing the resistance caused by the friction at the interface and reducing the energy consumption of the conveyor system.

Figure 4:
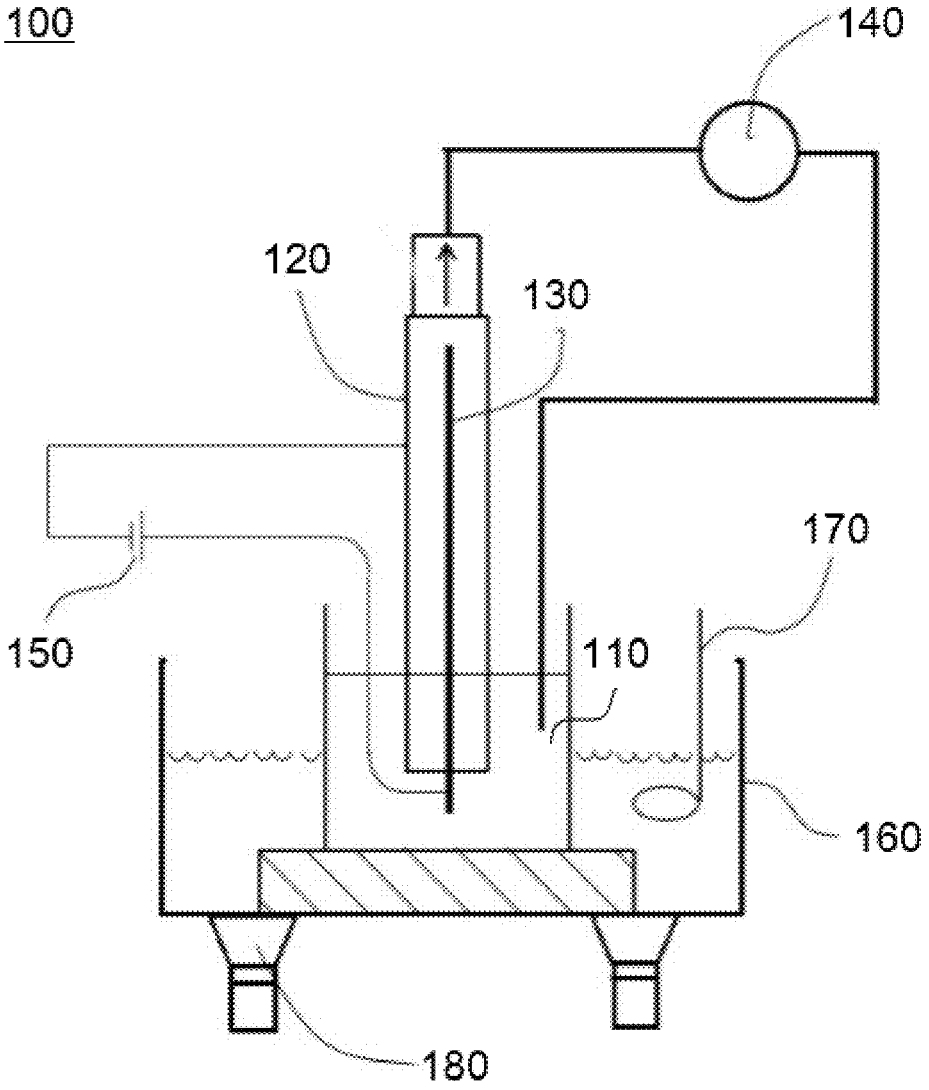
FIG. 4 is a schematic structural view of a device for preparing a high strength and durable super-hydrophobic film layer on an inner wall of an elongated metal tube according to the present invention.

As shown in FIG. 4, another object of the present invention aims to provide a device 100 for preparing a high strength and durable super-hydrophobic film layer on an inner wall of an elongated metal tube, which comprises a plating bath 110, a metal tube 120, a wire 130, a peristaltic pump 140, a power source 150, and an ultrasound system.

Wherein, the plating bath 110 contains a plating solution, and the plating bath 110 is disposed in the ultrasonic system. One end of the peristaltic pump 140 is connected to a second end of the metal tube 120, and the second end of the peristaltic pump 140 penetrates below the liquid level of the plating solution. Driven by the peristaltic pump 140, the circulation flow of the electroplating solution in the cavity of the plated metal tube can be formed, and the electrodeposition is performed under this condition.

Figure 5A:
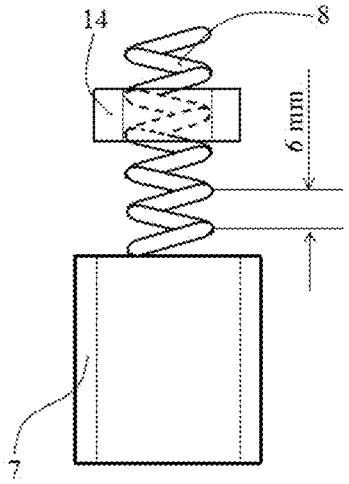
FIG. 5A is a schematic structural view of a metal wire fixed in a cavity of a metal tube.
Figure 5B:
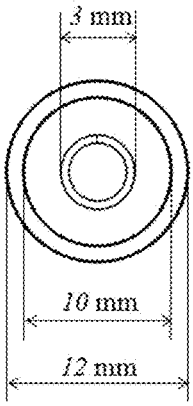
FIG. 5B is a top view of FIG. 5A.

The metal wire 130 penetrates into the metal tube 120, and both the first end of the metal wire 130 and the first end of the metal tube 120 penetrate below the liquid level of the plating solution. The metal wire 130 is connected to a positive electrode of the power source 150, and the metal tube 120 is connected to a negative electrode of the power source 150. Specifically, the metal wire 130 may be a nickel wire or a copper wire, and the like. When electrodeposition in the cavity of the tube is performed, it is necessary to ensure proper contact area between the anode and the solution during the electroplating process. Too high current density caused by the excessive contact area may cause damage to the structure of the plated layer, and too small contact area may in turn cause strong passivation which will affect the deposition process. In a specific implementation, the metal wire can be prepared into a spiral structure to increase the contact area. For example, as shown in FIG. 5A, a pure copper wire having a diameter of 0.5 mm is wound into a spiral structure, and the dimensional parameters thereof are as shown in FIGS. 5A and 5B, and the diameter of the spiral wire is 3 mm and the pitch is 5 mm. As shown in FIG. 5A, the outer side of the spiral wire was surrounded by EVA (ethylene-vinyl acetate copolymer) foam having a thickness of slightly more than 3.5 mm and a width of 0.5 mm, and fixed with glue. The fixing is performed once every 15 mm in the longitudinal direction on the spiral wire to ensure that the copper wire is in a coaxial position with the circular tube in the cavity of the tube.

The ultrasonic system includes a water bath 160, a heater 170, and an ultrasonic transducer 180. Since the longitudinal wave and energy of ultrasound can propagate along the fluid medium, it is not necessary to completely immerse the plating pieces into the electroplating solution during the plating process, as long as the inner wall of the tube is passed through the circulating fluid, the entire tube section can be uniformly plated under special conditions, thereby greatly reducing the consumption of device and raw materials.

When the nickel-phosphorus alloy layer is plated by the electroless plating method, the temperature of the water in the water bath 160 is controlled by the heater 170, the nickel wire is inserted into the cavity of the metal tube 120, and the peristaltic pump 140 is turned on to allow the electroplating solution to fill the cavity and form a circulating fluid stream. The power source 150 is turned on to form an initial nickel layer on the inner wall of the tube; then the anode nickel wire is taken out and the cycle is started for the electroless plating process.

When the functional coating is prepared, the temperature of the water in the water bath 160 is controlled by the heater 170 to be constant, the peristaltic pump 140 is turned on to fill the cavity of the metal tube 120 with the electroplating solution and form a circulating fluid stream, and then the ultrasonic wave is turned on, since the longitudinal wave of the ultrasound can propagate along a straight line in the fluid medium and is not easily attenuated, the ultrasonic energy can be uniformly obtained at various positions in the cavity of the vertically placed straight tube. After the power source 150 is turned on, the electrodeposition in the cavity of a tube can be performed in an ultrasonic environment.

When the low surface energy modification step is performed, the temperature of the water in the water bath 160 is controlled by the heater 170 to be constant, the peristaltic pump 140 is turned on to fill the cavity with the electroplating solution and form a circulating fluid stream, followed by a process of self-adsorption of the low surface energy monomer.

The present invention is described in detail below by means of specific examples.

Example 1

1) The stainless-steel tube with a size of φ14×1 mm and a length of 110 cm was rinsed with 1000 mL of distilled water, and then the inner surface was etched with 3.0 mol/L of hydrochloric acid for 15 min;

2) The steel tube was used as the cathode and the pure nickel wire was used as the anode and inserted into the inner wall of the steel tube, the device was connected according to FIG. 4, so that the electroless plating solution was filled in the tube and formed a circulation flow, the temperature of the water bath was controlled at 80° C., the DC power supply was switched on and energized at 1.7 V for 15 s, after the anode was taken out, the circulation was continued for 1 h to electroless plate a nickel-phosphorus alloy layer. The composition of the first plating solution used was: 0.24 mol/L of nickel chloride hexahydrate, 0.47 mol/L of sodium hypophosphite, 0.15 mol/L of trisodium citrate, and the brightener used was 4.0 mmol/L of sodium saccharin;

3) The steel tube plated with the nickel-phosphorus alloy layer was used as the cathode, and the copper wire was fixed as the anode in the steel tube according to the shape and size parameters in FIGS. 5A and 5B, and the device was connected, so that the plating solution containing nickel salt was filled in the tube and formed a circulation flow, the temperature of the water bath was controlled at 35° C. After the ultrasound was turned on, the DC power supply was switched on and energized at 2.0 V for 25 min, and a micro-nano scale functional coating was continuously formed on the surface of the nickel-phosphorus alloy plating layer. The second plating solution used was 0.09 mol/L of nickel sulfate hexahydrate, 0.15 mol/L of nickel chloride hexahydrate, 0.30 mol/L of boric acid, and 8.5 mmol/L of silica particles having an average particle diameter of 2 in. The added amphiphilic substance was 2.5 mmol/L of lauric acid, and the added brightener was 3.0 mmol/L of sodium saccharin; the used ultrasonic power was 250 W and the frequency was 40 kHz.

4) The steel tube coated with the functional layer was heat-treated at 270° C. for 1.5 h until it was completely hydrophilic, after which the device was connected, so that the volume fraction of the circulation flow within the tube was 0.1% of perfluorooctyl triethoxysilane in a mixed solution of ethanol-water with the mixing ratio of ethanol to water of 6:4, the temperature of the water bath was controlled at 85° C., and the modification time of the low surface energy substance was 2 h. Finally, the super-hydrophobic film layer can be uniformly plated in a stainless-steel tube with a length of up to 110 cm.

Example 2

1) The pure aluminum tube with a size of φ14×1 mm and a length of 30 cm was rinsed with 200 mL of distilled water, and then the inner surface was etched with 1.5 mol/L of hydrochloric acid for 10 min;

2) The aluminum tube was used as the cathode and the pure nickel wire was used as the anode and inserted into the inner wall of the steel tube, the device was connected according to FIG. 4, so that the electroless plating solution was filled in the tube and formed a circulation flow, the temperature of the water bath was controlled at 90° C., the DC power supply was switched on and energized at 1.5 V for 25 s, after the anode was taken out, the circulation was continued for 1.5 h to electroless plate a nickel-phosphorus alloy layer. The composition of the first plating solution used was: 0.32 mol/L of nickel chloride hexahydrate, 0.50 mol/L of sodium hypophosphite, 0.20 mol/L of trisodium citrate, and the brightener used was 3.0 mmol/L of sodium saccharin;

3) The aluminum tube plated with the nickel-phosphorus alloy layer was used as the cathode, and the copper wire was fixed as the anode in the aluminum tube according to the shape and size parameters in FIGS. 5A and 5B, and the device was connected, so that the plating solution containing nickel salt was filled in the tube and formed a circulation flow, the temperature of the water bath was controlled at 40° C. After the ultrasound was turned on, the DC power supply was switched on and energized at 2.5 V for 20 min, and a micro-nano scale functional coating was continuously formed on the surface of the nickel-phosphorus alloy plating layer. The second plating solution used was 0.10 mol/L of nickel sulfate hexahydrate, 0.17 mol/L of nickel chloride hexahydrate, 0.30 mol/L of boric acid, and 12.5 mmol/L of silica particles having an average particle diameter of 3 μm. The added amphiphilic substance was 2.5 mmol/L of octadecylamine, and the added brightener was 2.0 mmol/L of sodium saccharin; the used ultrasonic power was 350 W and the frequency was 50 kHz.

4) The aluminum tube plated with the functional layer was heat-treated at 270° C. for 1.5 h until it was completely hydrophilic, after which the device was connected, so that the volume fraction of the circulation flow within the tube was 0.1% of perfluorooctyl triethoxysilane in a mixed solution of ethanol-water with the mixing ratio of ethanol to water of 7:3, the temperature of the water bath was controlled at 90° C., and the modification time of the low surface energy substance was 2 h, so that a aluminum tube with a super-hydrophobic inner coating can be obtained.

Example 3

1) The pure copper tube with a size of φ14×1 mm and a length of 20 cm was rinsed with 100 mL of distilled water, and then the inner surface was etched with 3.0 mol/L of nitric acid for 15 min;

2) The copper tube was used as the cathode and the pure nickel wire was used as the anode and inserted into the inner wall of the copper tube, the device was connected according to FIG. 4, so that the electroless plating solution was filled in the tube and formed a circulation flow, the temperature of the water bath was controlled at 80° C., the DC power supply was switched on and energized at 1.5 V for 20 s, after the anode was taken out, the circulation was continued for 1 h to electroless plate a nickel-phosphorus alloy layer. The composition of the plating solution used was: 0.25 mol/L of nickel chloride hexahydrate, 0.45 mol/L of sodium hypophosphite, 0.13 mol/L of trisodium citrate, and the brightener used was 3.5 mmol/L of sodium saccharin;

3) The copper tube plated with the nickel-phosphorus alloy layer was used as the cathode, and the copper wire was fixed as the anode in the copper tube according to the shape and size parameters in FIGS. 5A and 5B, and the device was connected, so that the plating solution containing nickel salt was filled in the tube and formed a circulation flow, the temperature of the water bath was controlled at 40° C. After the ultrasound was turned on, the DC power supply was switched on and energized at 1.8 V for 15 min, and a micro-nano scale functional coating was continuously formed on the surface of the nickel-phosphorus alloy plating layer. The plating solution used was 0.08 mol/L of nickel sulfate hexahydrate, 0.13 mol/L of nickel chloride hexahydrate, 0.32 mol/L of boric acid, and 13.3 mmol/L of silica particles having an average particle diameter of 1 μm. The added amphiphilic substance was 2.5 mmol/L of lauric acid, and the added brightener was 3.0 mmol/L of sodium saccharin; the used ultrasonic power was 200 W and the frequency was 30 kHz.

4) The copper tube coated with the functional layer was heat-treated at 270° C. for 1 h until it was completely hydrophilic, after which the device was connected, so that the volume fraction of the circulation flow within the tube was 0.1% of perfluorooctyl triethoxysilane in a mixed solution of ethanol-water with the mixing ratio of ethanol to water of 7:3, the temperature of the water bath was controlled at 85° C., and the modification time of the low surface energy substance was 2 h.

5) The water flow impact resistance test was carried out in the tube, the specific method was as follows: the tube was passed through a water flow of 450 L/h, and washed out for 10 minutes at one time, and then the copper tube was taken out and its inner wall was not wetted, and the WCA (static water contact angle) of the inner surface was measured and found to be still maintained at about 120°. After the copper tube was treated at 80° C. for 5 min, the WCA was found to be restored to 135° or more, the above experimental procedure was repeated for 3 times, it was found that the WCA of the inner wall was difficult to reach 110° after oven-drying. This indicated that the plating layer formed by electrodeposition induced purely by ultrasound was difficult to form a long-term resistance to water flow impact.

Example 4

1) The pure copper tube with a size of φ14×1 mm and a length of 20 cm was rinsed with 100 mL of distilled water, and then the inner surface was etched with 3.0 mol/L of nitric acid for 15 min.

2) The copper tube was used as the cathode and the pure nickel wire was used as the anode and inserted into the inner wall of the copper tube, the device was connected according to FIG. 3, so that the electroless plating solution was filled in the tube and formed a circulation flow, the temperature of the water bath was controlled at 80° C., the DC power supply was switched on and energized at 1.5 V for 20 s, after the anode was taken out, the circulation was continued for 1 h to electroless plate a nickel-phosphorus alloy layer. The composition of the plating solution used was: 0.25 mol/L of nickel chloride hexahydrate, 0.40 mol/L of sodium hypophosphite, 0.13 mol/L of trisodium citrate, and the brightener used was 3.5 mmol/L of sodium saccharin;

3) The copper tube plated with the nickel-phosphorus alloy layer was used as the cathode, and the copper wire was fixed as the anode in the copper tube according to the shape and size parameters in FIGS. 5A and 5B, and the device was connected, so that the plating solution containing nickel salt was filled in the tube and formed a circulation flow, the temperature of the water bath was controlled at 40° C.; after the ultrasound was turned on, the DC power supply was switched on and energized at 1.8 V for 15 min, and a micro-nano scale functional coating was continuously formed on the surface of the nickel-phosphorus alloy plating layer. The plating solution used was 0.08 mol/L of nickel sulfate hexahydrate, 0.13 mol/L of nickel chloride hexahydrate, 0.32 mol/L of boric acid, and 13.3 mmol/L of silica particles having an average particle diameter of 1 μm. The added amphiphilic substance was 2.5 mmol/L of lauric acid, and the added brightener was 3.0 mmol/L of sodium saccharin; the used ultrasonic power was 200 W and the frequency was 30 kHz.

4) The copper tube coated with the functional layer was heat treated at 270° C. for 1 h until it was completely hydrophilic, and then the pure nickel wire was used as the cathode, the copper tube was used as the anode, the device was connected, so that 0.3 mol/L of potassium chloride solution was filled in the tube and formed a circulation flow, the pH of the solution was adjusted to 4 with dilute hydrochloric acid, the DC power supply was turned on and anodized at 1 V for 3 min.

5) The copper tube with which the final film layer was obtained was connected to the device, so that the volume fraction of the circulation flow within the tube was 0.1% of perfluorooctyl triethoxysilane in a mixed solution of ethanol-water with the mixing ratio of ethanol to water of 7:3, the temperature of the water bath was controlled at 85° C., and the modification time of the low surface energy substance was 2 h, finally, a uniform and dense super-hydrophobic film layer with excellent resistance to water flow impact can be obtained on the inner wall of the copper tube.

6) The super-hydrophobic film layer produced by coupling ultrasonic assisted electrodeposition and anodization has better resistance to water flow impact. The water flow impact resistance test was carried out in the tube as follows: the tube was passed through a water flow of 450 L/h, and washed out for 10 minutes at one time, and then the copper tube was taken out and its inner wall was not wetted, and the WCA of the inner surface was measured and found to be still maintained at about 120°. After the copper tube was treated at 80° C. for 5 min, the WCA was found to be restored to 140° or more. The above experimental procedure was repeated for 5 times, it was found that the each WCA can still recover to 140° or more after oven-drying, and the wall surface does not have obvious wetting phenomenon. Compared with Example 3, it showed that the surface of the film layer with many nanochannel structure obtained by the anodizing step has excellent resistance to water flow impact.

Example 5

1) The pure copper tube with a size of φ14×1 mm and a length of 55 cm was rinsed with 500 mL of distilled water, and then the inner surface was etched with 2.5 mol/L of nitric acid for 20 min.

2) The copper tube was used as the cathode and the pure nickel wire was used as the anode and inserted into the inner wall of the copper tube, the device was connected according to FIG. 4, so that the electroless plating solution was filled in the tube and formed a circulation flow, the temperature of the water bath was controlled at 85° C., the DC power supply was switched on and energized at 1.7 V for 20 s, after the anode was taken out, the circulation was continued for 1 h to electroless plate a nickel-phosphorus alloy layer.

3) The copper tube plated with the nickel-phosphorus alloy layer was used as the cathode, and the copper wire was fixed as the anode in the copper tube according to the shape and size parameters in FIGS. 5A and 5B, and the device was connected, so that the plating solution containing nickel salt was filled in the tube and formed a circulation flow, the temperature of the water bath was controlled at 36° C.; after the ultrasound was turned on, the DC power supply was switched on and energized at 1.6 V for 25 min, and a micro-nano scale functional coating was continuously formed on the surface of the nickel-phosphorus alloy plating layer. The plating solution used was 0.07 mol/L of nickel sulfate hexahydrate, 0.15 mol/L of nickel chloride hexahydrate, 0.32 mol/L of boric acid, and 12 mmol/L of silica particles having an average particle diameter of 2 μm. The added amphiphilic substance was 2.5 mmol/L of stearic acid, and the added brightener was 2.5 mmol/L of sodium saccharin. The used ultrasonic power was 250 W and the frequency was 40 kHz.

4) The copper tube coated with the functional layer was heat treated at 280° C. for 1.5 h until it was completely hydrophilic, and then the pure nickel wire was used as the cathode, the copper tube was used as the anode, the device was connected, so that 0.25 mol/L of potassium chloride solution was filled in the tube and formed a circulation flow, the pH of the solution was adjusted to 3 with dilute hydrochloric acid, the DC power supply was turned on and anodized at 1 V for 4 min.

5) The copper tube with which the final film layer was obtained was connected to the device, so that the volume fraction of the circulation flow within the tube was 0.1% of perfluorooctyl triethoxysilane in a mixed solution of ethanol-water with the mixing ratio of ethanol to water of 6:4, the temperature of the water bath was controlled at 85° C., and the modification time of the low surface energy substance was 1.5 h, finally, a uniform and dense super-hydrophobic film layer with excellent resistance to water flow impact can be obtained on the inner wall of the copper tube.

Figure 6:
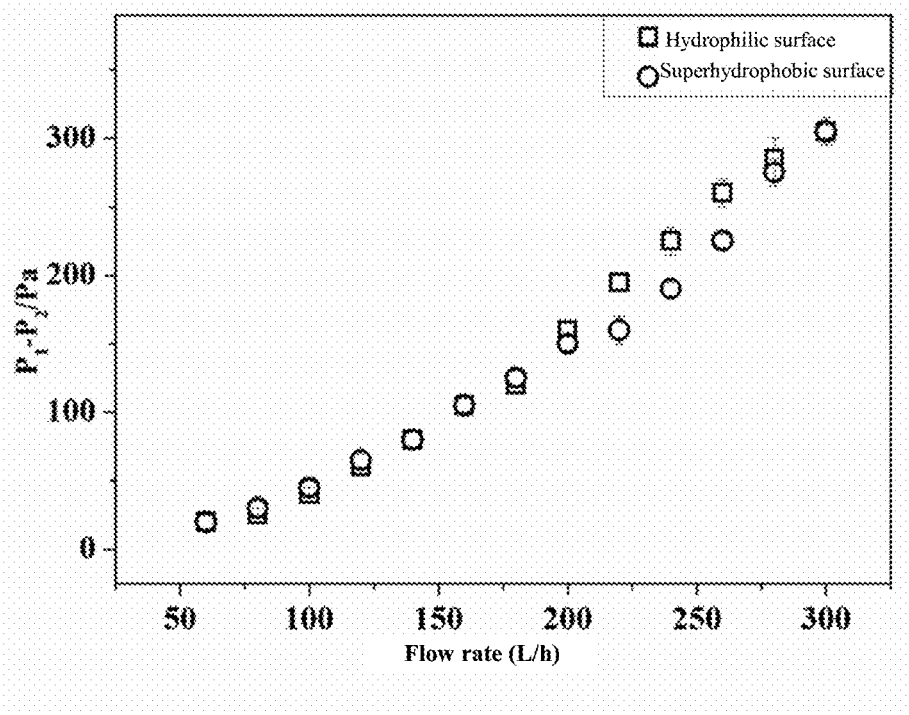
FIG. 6 is a comparison diagram of the flowing pressure difference of the tubes with hydrophilic and super-hydrophobic inner surface of Example 6.

6) In order to determine the drag reduction effect of the inner wall of the super-hydrophobic functional tube, the comparison experiment was designed as follows:

Compared with the same-sized copper tube etched purely by 2.5 mol/L of nitric acid for 20 min, the water flow of 60 L/h to 260 L/h was sequentially passed through the two tubes, and the distance between the pressure measuring points was selected to be 40 cm. The static pressure difference ($P_1-P_2$) between the two pressure measuring points was measured every 20 L/h, and the obtained results were shown in FIG. 6. The experimental results showed that the super-hydrophobic inner surface can obtain the drag reduction effect at a certain flow rate, with a maximum of about 17.9%.

In summary, a method for preparing a high-strength and durable super-hydrophobic film layer on an inner wall of an elongated metal tube according to the present invention utilizes low-power ultrasound to transfer energy through a fluid medium in the cavity of an elongated tube and the low-power ultrasound is not easily attenuated, therefore a stable ultrasonic field is formed throughout the cavity of an elongated tube, which greatly reduces the influence of local mass transfer resistance, and a uniform nanocrystalline film layer is prepared under the induction of ultrasound. Since only the electroplating solution is needed to be filled in the tube during the preparation process of the present invention, it is not necessary to completely immerse the plating pieces into the electroplating solution during the plating process, as long as the inner wall of the tube is passed through the circulating fluid, the entire tube section can be uniformly plated under special conditions, thereby greatly reducing the consumption of device and raw materials. Pre-plating a dense layer of a nickel-phosphorus alloy in the metal tube under the functional layer of the porous structure during the preparation process not only greatly enhances the anti-corrosive medium capacity of the film, but also facilitates the more regular and orderly growth of the nano-grains under ultrasound, thereby greatly improving the interlayer bonding force of the coating film. The thickness of the resulting deposited layer can reach 10 μm or more within a shorter preparation time (less than 30 minutes) and the hardness can reach more than 21H, and the metallic microscopic size structure is not easily damaged by the impact of high-strength fluid or friction of hard object, thereby ensuring the stability of the rough structure. Due to the combined action of direct contact of the dense nanocrystalline film layer, the super-hydrophobic surface blocking liquid and the solid phase, the inner wall of the tube has excellent resistance to fluid medium corrosion and self-cleaning property. On the other hand, the air film formed by plating the super-hydrophobic surface as passing through the fluid medium can effectively reduce the direct contact between the fluid and the rough structure at the interface and produce the slippage of the fluid particles, thereby greatly reducing the resistance caused by the friction at the interface and reducing the energy consumption of the conveyor system. The nanochannel structure obtained by the anodizing step ensures long-term maintenance of the non-wetting state of the film layer in the tube under strong water flow impact conditions.

What is claimed is:

1. A method for preparing a high-strength and durable super-hydrophobic film layer on an inner wall of an elongated metal tube, comprising steps of:

roughening treatment of the inner wall of the elongated metal tube comprising: etching the inner wall of the elongated metal tube with 2 mol/L to 4 mol/L of nitric acid or 2 mol/L to 4 mol/L of hydrochloric acid for 5 min to 30 min, so that a rough structure is formed on the inner wall of the elongated metal tube; and exposing an active surface of the inner wall of the elongated metal tube;

preparation of a nickel-phosphorus alloy layer comprising: depositing the nickel-phosphorus alloy layer on the inner wall of the rough metal tube by use of an electroless plating method, wherein: a first plating solution used in the electroless plating method comprises: 0.1 mol/L to 1 mol/L of nickel chloride hexahydrate, 0.1 mol/L to 1 mol/L of sodium hypophosphite, 0.1 mol/L to 1 mol/L of trisodium citrate and 0.001 mol/L to 0.01 mol/L of brightener; and a temperature of a first plating bath is from 60° C. to 90° C.;

preparation of a functional coating comprising: electrodepositing a functional coating on the nickel-phosphorus alloy layer, wherein: an electrodeposition bath is operated under an ultrasonic environment to form a micron- or submicron-sized channel structure; a second plating solution used for electrodeposition of the functional coating comprises: 0.01 mol/L to 0.1 mol/L of nickel sulfate hexahydrate, 0.1 mol/L to 1 mol/L of nickel chloride hexahydrate, 0.1 mol/L to 1 mol/L of boric acid, 0 mol/L to 0.1 mol/L of silica particles and 0.001 mol/L to 0.05 mol/L of amphiphilic substance; a temperature of a second plating bath is from 15° C. to 50° C.; an ultrasonic frequency for the second plating bath is from 20 kHz to 60 kHz; and a power is from 150 W to 400 W;

performing heat treatment on a surface of the functional coating at a temperature from 100° C. to 350° C. for 0.5 h to 2 h;

performing anodization comprising: inserting a nickel wire as a cathode into a cavity of the elongated metal tube and the elongated metal tube as an anode into a third solution; anodizing under a condition of fluid circulation at room temperature for 1 min to 10 min, and an applied voltage of 1 V to 5 V, wherein a composition of the third solution comprises 0.25 mol/L to 0.1 mol/L of potassium chloride at pH of 2.0 to 6.0; and performing a low surface energy modification with a mixed solution of ethanol-water dissolved with a low surface energy substance, wherein: a mass ratio of ethanol to water in the mixed solution of ethanol-water is from (1:9) to (9:1); a temperature of the mixed solution of ethanol-water is from 60° C. to 90° C.; and a time of the low surface energy modification is from 1 hour to 3 hours.

2. The method in claim 1, wherein:

prior to the nickel-phosphorus alloy layer preparation step, the cavity of the elongated metal tube is filled with the first plating solution; and then a pure nickel wire is inserted into the elongated metal tube;

the elongated metal tube is used as a cathode;

the pure nickel wire is used as an anode;

the pure nickel wire is energized for 1 second to 30 seconds at the applied voltage of 1 V to 3 V; and then the pure nickel wire is electroplated under a fluid circulation condition to prepare a nickel-phosphorus alloy layer.

3. The method in claim 1, wherein the brightener in the nickel-phosphorus alloy layer preparation step comprises at least one of leucine, sodium saccharin, coumarin and 1,4-butynediol.

4. The method in claim 1, wherein the amphiphilic substance in the functional coating preparation step comprises at least one of octadecylamine, dodecanoic acid, tetradecanoic acid and octadecanoic acid.

5. The method in claim 1, wherein the silica particles in the functional coating layer preparation step have a particle size of 0.1 μm to 5 μm.

6. The method in claim 1, wherein the low surface energy substance in the low surface energy modification step comprises at least one of heptadecafluorodecyl trimethoxysilane, tridecafluorooctyl triethoxysilane, tridecafluorooctyl trimethoxysilane and perfluorooctyl triethoxysilane.

7. The method in claim 1, wherein the functional coating preparation step comprises:

preparing a pure copper wire into a spiral shape to be inserted into the elongated metal tube, the pure copper wire being coaxial with the elongated metal tube;

then turning a power of an ultrasonic source on to form a circulating fluid of the second plating solution; and after the power of the ultrasonic source is switched on, the ultrasonic source is energized for 1 minute to 30 minutes at the applied voltage of 0.5 V to 3 V to prepare the functional coating.

* * * * *